United States Patent [19]

Ahonen

[11] Patent Number: 4,656,783

[45] Date of Patent: Apr. 14, 1987

[54] INSULATION OF STRUCTURES

[76] Inventor: Pentti Ahonen, 55 Franklin St., Milton, Mass. 02186

[21] Appl. No.: 589,530

[22] Filed: Apr. 5, 1984

Related U.S. Application Data

[63] Continuation of Ser. No. 371,556, Apr. 26, 1982, abandoned.

[51] Int. Cl.[4] ..... E04B 1/62; E06B 7/23

[52] U.S. Cl. ..... 49/404; 49/489

[58] Field of Search ..... 52/204, 397; 49/432, 49/434, 488, 489, 404

[56] References Cited

U.S. PATENT DOCUMENTS

| | | | |
|---|---|---|---|
| 771,133 | 9/1904 | Edwards | 49/488 |
| 871,216 | 11/1907 | Erb | 49/488 |
| 1,946,728 | 2/1934 | Bell | 49/432 |
| 2,589,364 | 3/1952 | Fry | 49/488 |
| 2,792,088 | 5/1957 | Blanchard . | |
| 3,305,973 | 2/1967 | Bohn | 49/488 |
| 3,341,975 | 9/1967 | Tylisz | 49/488 |
| 3,430,384 | 3/1969 | Malenfant | 49/488 |
| 3,466,804 | 9/1969 | Swanecle | 49/488 |
| 3,729,869 | 5/1973 | Wenig | 49/489 |

FOREIGN PATENT DOCUMENTS 2002980 7/1971 Fed. Rep. of Germany .

*Primary Examiner*—Leslie A. Braun
*Assistant Examiner*—John Malcolm White
*Attorney, Agent, or Firm*—Wolf, Greenfield & Sacks

[57] ABSTRACT

Insulation of structures making use of plastic strips which are proportioned and disposed to achieve a desired insulation effect.

15 Claims, 4 Drawing Figures

INSULATION OF STRUCTURES

This application is a continuation of Ser. No. 371,556 file Apr. 26, 1982, now abandoned.

BACKGROUND OF THE INVENTION

This invention relates to the insulation of structures, and, more particularly, to the insulation of movable panels such as windows which are slidable relative to one another.

In order to provide for the insulation of slidable panels such as windoes, it is common practice to employ an auxiliary window or panel which is known as a storm window. This procedure requires the use of a separate panel which must be mounted and removed according to the season of the year. In the winter the storm windows are applied to the structure and in the summer they are typically removed and replaced by screens.

In order to eliminate the inconvenience associated with the need for removing and replacing the windows, attempts have been made to combine the storm windows, screens and utility windows in a unitary structure. The result is mechanical complexity, a complicated structure that is cumbersome to deal with and significant additional cost.

Accordingly, it is an object of the invention to facilitate the insulation of movable panels, particularly panels that are used as conventional windows.

Another object of the invention is to achieve the insulation of such panels by a simple modification of the panel structure, without requiring the use of additional panels or windows of the kind customarily employed.

Still another object of the invention is to achieve an insulative effect which retains its insulative quality over an extend interval of time.

A further object of the invention is to achieve suitable insulation of panels with enhanced efficiency and reduced cost.

SUMMARY OF THE INVENTION

In accomplishing the foregoing and related objects, the invention provides recessed grooves in the side surfaces of slidable panel members, with an elongated insulating strip inserted into the groove.

In accordance with one aspect of the invention, the recessed groove is formed by a right angle depression which desirably commences on a face of the panel. The right angle groove is formed by surfaces which intersect each other at a right angle along a slot with a diagonal recess that commences with a taper of narrow width at the intersection of the two recess forming surfaces and diverges into the interior of the panel to form a secure seal for an insulating strip.

In accordance with another aspect of the invention, the insulating strip has a base portion which is complimentary to the surface into which it is inserted, by, for example, being slidably moved into position along the groove. This results in a secure attachment of the insulating strip to the panel without requiring fastners or adhesives that could deteriorate during the passage of time.

In accordance with still another aspect of the invention, the face of the panel which is normally in sliding contact with another object or panel also contains in its face a recessed groove that receives an insulating strip.

In the case of the conventional type of window used in housing, four aspect of the invention, are included, one along each side of the window, with three of the strips being positioned in recesses that are formed by depressed surfaces commencing on the customary rear surface of the window and extending inwardly into the fram less than half its thickness to a vertical ledge. The intersection of the vertical ledge and the base apron are provided with a slot that depresses inwardly into the frame for securely receiving the insulating strip. The fourth strip is on the rear face of the window at the position of its lower edge. In the case of a window section that mates with the foregoing, an insulating strip on only one of the panels is required, but complimentary constructions may be employed to provide an enhanced insulative effect.

DESCRIPTION OF THE DRAWINGS

Other aspects of the invention will become apparent after considering several illustrative embodiments taken in conjunction with the drawings in which.

DETAILED DESCRIPTION

Figure 1A:
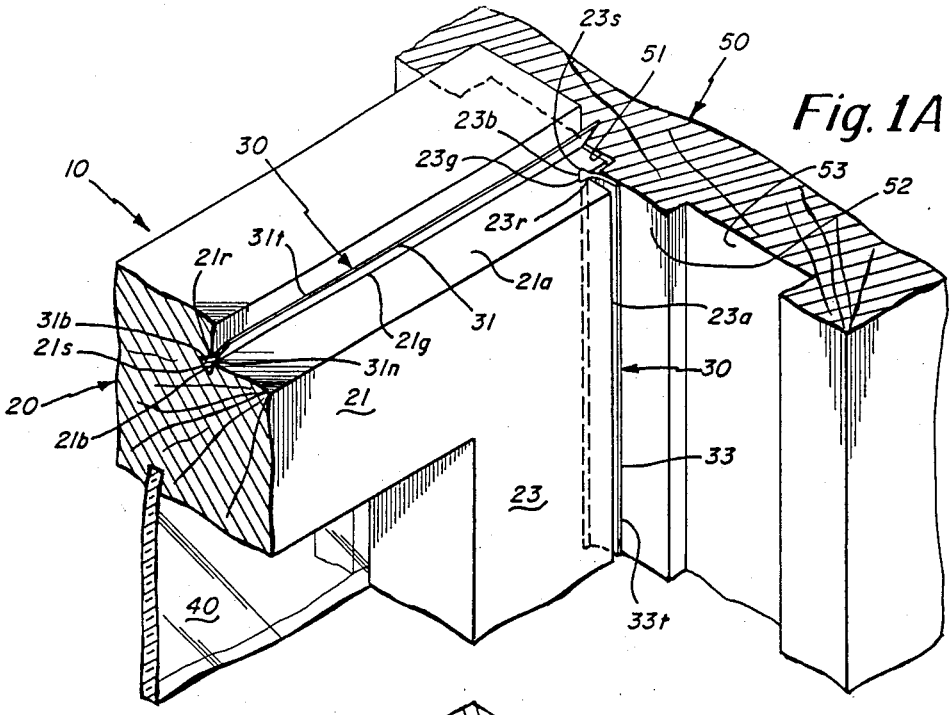
FIG. 1A is a top corner of a movable panel with insulating strips in accordance with the invention.

With reference to the drawings, FIG. 1A shows a fragmentary corner portion of a movable panel that is insulated in accordance with the invention.

The panel 10 is formed by a frame 20 with insulating strips 30. The particular panel 10 of FIG. 1A serves as a window and for that purpose includes a central glass portion 40. In order to achieve the desired slidability, an edge of the frame moves in a guide channel 51 of an associated supporting structure 50.

The panel 10 illustratively has a rectangular frame with upper and lower crosspieces, of which only the upper crosspiece 21 is visible in FIG. 1A. Another pair of crospieces is provided to complete the frame 20, of which only the additional crosspiece 23 is visible in FIG. 1A.

Each of the pieces, for example 21 and 23, that can move into contact with another structure includes an insulating strip 30. In particular, when contact is made at the side of the frame, the insulating strip 30 is set in a groove, such as the grooves **21*g* and 23*g* in FIG. 1B**.

The base of each groove **21*g* and 23*g* includes a slot 21*s* and 23*s* for the associated insulating strip 31 and 33**.

Each slot **21*s* and 23*s* has a relatively wide base 21*b* and 23*b* which leads to a restricted opening 21*r* and 23*r*. The associated insulating strips 31 and 33 are proportioned to be slidable into the slots 21*s* and 23*s*. Accordingly, each strip 31 and 33 has an enlarged base 31*b* and 33*b* which converges to a neck 31*n* and 33*n*, and thereafter extends to a narrow tip 31*t* and 33*t*. It will be understood that the configuration of the base 31*b* and 33*b* is not critical, the only requirement being that it be able to engage and mate with the corresponding base 21*b* and 23*b* in the groove 21*g* and 23*g***.

The extension of the strip 31 and 33 from their associated grooves **21*g* and 23*g* is limited only by the width of the aprons 21*a* and 23*a* associated with the grooves 21*g* and 23*g*. Since the panel 10 is slidable it can come into contact with a support structure that will hold the tip 31*t* and 33*t* against the associated aprons 21*a* and 23*a*. Consequently, the strip, when folded, should not extend beyond the edge of the apron. In the view of FIG. 1A, the strip 31 has not yet engaged in a proposed surface of the support structure but the strip 33 is shown in insulating contact with a side member 52 of the support structure 50**. This contact is more clearly visible in FIG. 1B.

Figure 1B:
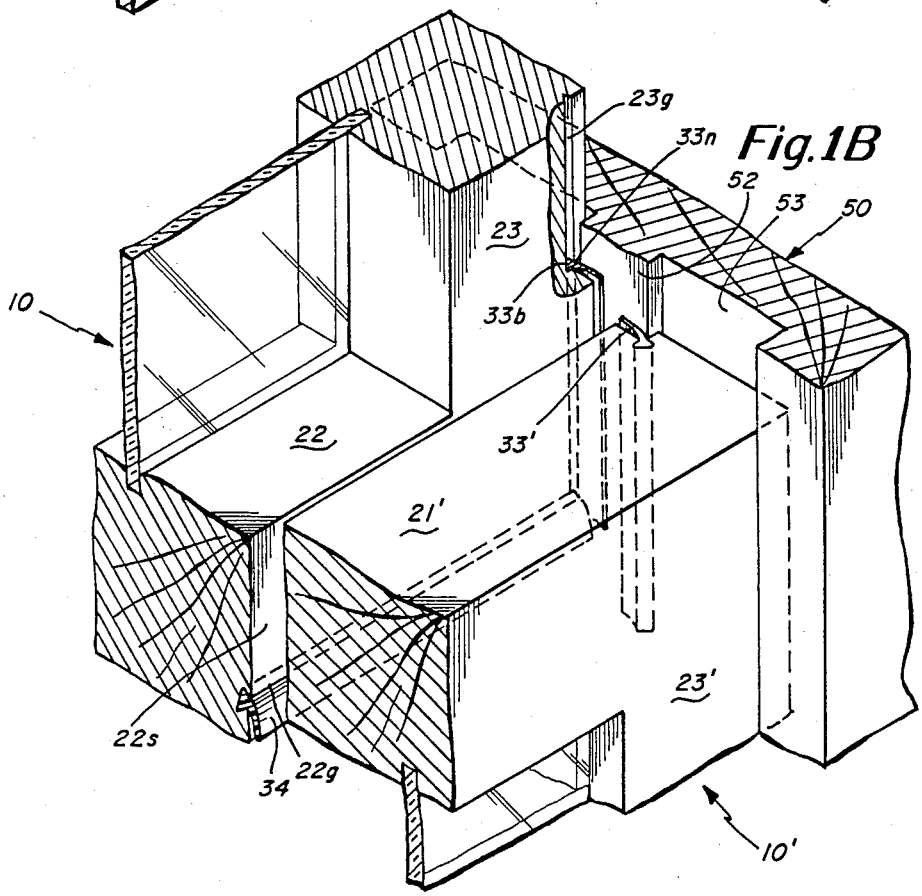
FIG. 1B is a fragmentary view of mating panels with insulating strips in accordance with the invention.

In addition, FIG. 1B indicates that where the panel 10 can make facial contact with another member, such as a second panel 10', an insulating strip 34 is provided on the face of the corsspiece 22. The strip 34 has the same general configuration and the same kind of retention groove **22*g* as for the associated crosspiece 21. However, the groove does not have a recess and is simply provided in the surface 22*s* of the crosspiece 22**.

Figure 2A:
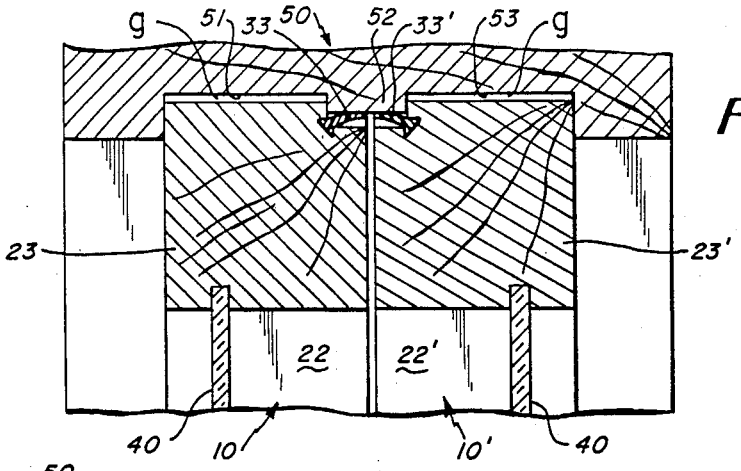
FIG. 2A is a cross-sectional view of FIG. 1B.

The relationship between the panels 10 and 10' is indicated more clearly in FIG. 2A which is a cross-sectional view of FIG. 1B. The support structure, illustrative the casement of a dwelling, has channels 51 and 53 separated by an elevated runner 52. The side member 23 of the panel 10 includes the insulating strip 33 discussed in conjunction with FIG. 1B. Similarly, the side piece 23' of the second panel 10' includes an insulating strip 33' corresponding to the strip 33 discussed previously. As also indicated in FIG. 2A, the side member 23, also the associated side member 23', is provided with a gap g relative to the base of the channels 51 and 53. Under ordinary circumstances, these gaps permit air to pass through the spaces at the edges of the panel to the interior of the dwelling. However, in the case of the invention, the insulating strips 33 and 33' seal the passages and curtail the flow, thus providing the desired insulating effect.

Figure 2B:
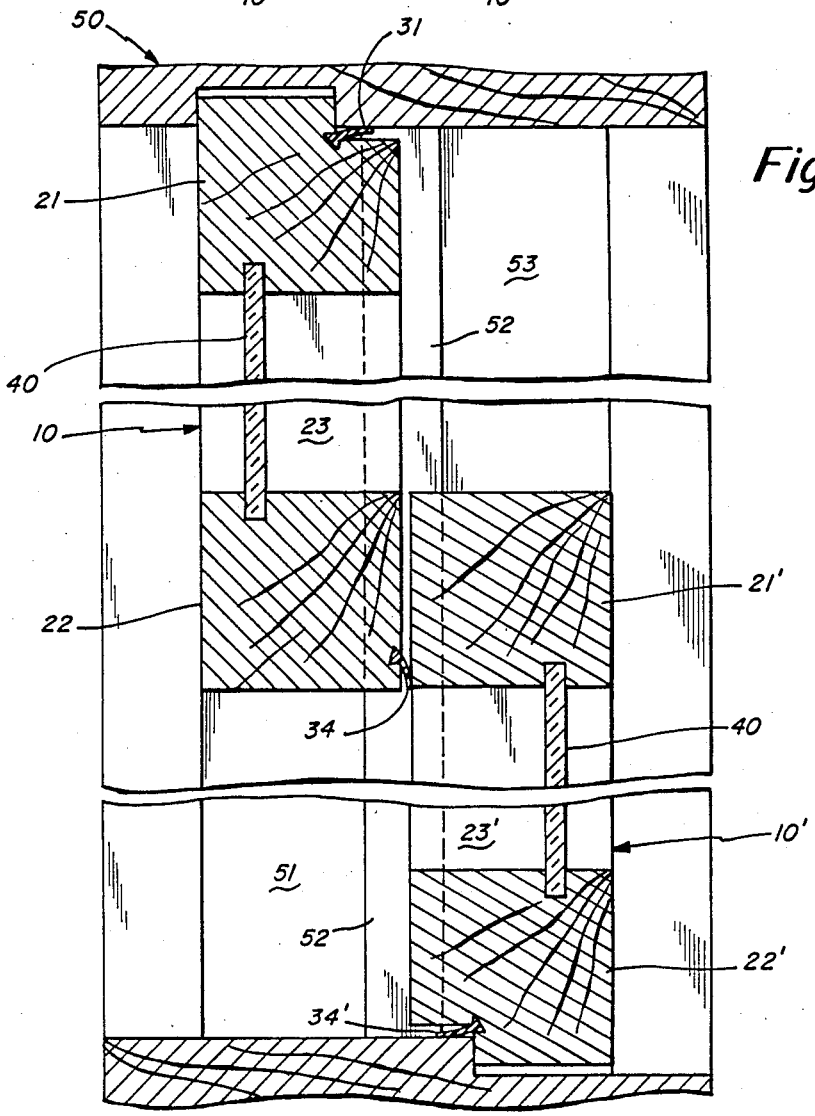
FIG. 2B is a side sectional view of movable panel corresponding to FIG. 1B.

The similar role of the insulating strips 31 and 32, as well as the role of the lowermost strip 32' is illustrated in the side sectional view of FIG. 2B.

What is claimed is:

1. An insulated panel forming at least part of a window and comprising a supporting structure for the window including a mating surface, frame, said frame having separate double-hung window panels which are vertically movable relative to the mating surfaces in which the panels are slidable, each such panel having an elongated groove along at least one side of the panel, each said groove comprising a slot having a relatively wide base leading to a restricted opening, and an insulating strip proportioned to be slidable into said accommodating slot and comprising an enlarged base received by the wide base of the slot and converging to a restricted neck and thereafter extending laterally to a narrow blade-like tip, said restricted neck of the insulating strip being locked into said slot by said restricted opening, said narrow tip extending longitudinally parallel to said groove and disposed in a sealing position between an apron of the frame and the mating surface, said tip maintained in the same position between the apron and mating surface in all positions of the panel, said apron defined by a recess in the frame from which said slot extends, said narrow tip being disposed inside of the outer extremity of the frame, wherein each panel has an edge recess forming adjacent aprons with each panel frame having an insulating strip with the narrow longitudinally extending tips thereof disposed in intimate facing relation tip-to-tip and at least partially vertically overlapping when the window is closed, the edge recesses in the panels being disposed in juxtaposition to form a single recess, said mating surface being defined by an elevated runner narrower than the panels and positioned to extend into the adjacent recesses of the facing panels, said facing tips both contacting and sealing against said elevated runner;

said elevated runner having a flat strip-contacting surface against which both insulating strips are urged, said laterally extending tips of the insulating strips disposed along a substantial length thereof into intimate contact with said flat strip-contacting surface.

2. A panel as defined in claim 1 wherein said frame is slidable within a casement and opposed grooves that face opposed portions of said casement contain insulating strips.

3. A panel as defined in claim 2 wherein said insulating strip extends along the interior side of the panel.

4. A panel as defined in claim 3 further including a groove that extends at right angles to the side grooves and contains an insulating strip therein.

5. A panel as defined in claim 4 wherein the insulating strip in the transverse groove extends the entire length of said groove.

6. A panel as defined in claim 1 wherein each groove is formed by a right angular depression in each of said sides.

7. A panel as defined in claim 6 wherein said depression commences at an outer fae of said panel.

8. A panel as defined in claim 1 further including at least one insulating strip on a face of said panel disposed in a sealing position between an apron of the panel supporting the insulating strip and an adjacent panel but only when the window is closed.

9. A panel as defined in claim 8 wherein the insulating strip on said panel is at an edge thereof and is proportioned to engage a surface that moves parallel to said surface containing said strip.

10. A panel as defined in claim 1 wherein said recess is an edge recess extending longitudinally and between orthogonally disposed surfaces of the frame including a side surface slideable against said mating surface.

11. A panel as defined in claim 10 wherein said recess is orders of magnitude longer than it is wide.

12. A panel as defined in claim 11 wherein said edge recess is defined by substantially right angled surfaces with the elongated slot being disposed substantially at the junction of said right angled surfaces.

13. A panel as defined in claim 11 wherein said recess is wider than it is deep.

14. A panel as defined in claim 13 wherein the length that the tip of the insulating strip extends from the elongated slot is substantially the same as the width of the edge recess.

15. A panel as defined in claim 14 wherein said edge recess is defined by substantially right angled surfaces with the elongated slot being disposed substantially at the junction of said right angled surfaces.

* * * * *